US010602859B2

(12) United States Patent
Bacallao

(10) Patent No.: US 10,602,859 B2
(45) Date of Patent: Mar. 31, 2020

(54) PANEL POWERED PRODUCE DISPLAY TABLE

(71) Applicant: Walmart Apollo, LLC, Bentonville, AR (US)

(72) Inventor: Yurgis Mauro Bacallao, Centerton, AR (US)

(73) Assignee: WALMART APOLLO, LLC, Bentonville, AR (US)

( * ) Notice: Subject to any disclaimer, the term of this patent is extended or adjusted under 35 U.S.C. 154(b) by 107 days.

(21) Appl. No.: 15/880,016

(22) Filed: Jan. 25, 2018

(65) Prior Publication Data

US 2018/0228302 A1 Aug. 16, 2018

Related U.S. Application Data

(60) Provisional application No. 62/458,817, filed on Feb. 14, 2017, provisional application No. 62/458,822, filed on Feb. 14, 2017.

(51) Int. Cl.
*A47F 3/04* (2006.01)
*A47F 5/00* (2006.01)
(Continued)

(52) U.S. Cl.
CPC ..... *A47F 3/0408* (2013.01); *A47B 75/00* (2013.01); *A47F 5/0018* (2013.01);
(Continued)

(58) Field of Classification Search
CPC .... A47F 3/0408; A47F 5/0018; A47F 7/0071; A47F 2003/046; A47F 3/0478; A47B 75/00
See application file for complete search history.

(56) References Cited

U.S. PATENT DOCUMENTS 3,293,878 A * 12/1966 Barroero ..... A47F 3/0482 62/255
4,003,728 A 1/1977 Rath
(Continued)

FOREIGN PATENT DOCUMENTS

GB 2374918 A * 10/2002 ..... A23G 9/225
GB 2374918 A 10/2002

OTHER PUBLICATIONS

Energy Star(R), "8. Air Distribution Systems," Energy Star(R) Building Manual, Revised Apr. 2008, pp. 1-27.
(Continued)

*Primary Examiner* — Frantz F Jules
*Assistant Examiner* — Lionel Nouketcha
(74) *Attorney, Agent, or Firm* — Schmeiser, Olsen & Watts LLP; Timothy P. Collins

(57) ABSTRACT

A display table for displaying perishable produce items comprises a base; a produce bed on which the perishable produce items are positioned; and an air flow system for providing air circulation and ventilation at the produce bed. The air flow system comprises a plurality of ducts under the produce bed; an air distribution box that evenly distributes the air through the ducts; and a plurality of fans that circulate the air from the ducts under the produce bed to a region above the produce bed. The display table further comprises a control device that controls a flow of the air via the fans to the produce bed according to a state of the perishable produce items on the produce bed; and a self-contained power panel that generates power for the fans, the air distribution box, and the control device, wherein the power panel includes a cell power electrical system.

17 Claims, 6 Drawing Sheets

(51) Int. Cl.
*A47B 75/00* (2006.01)
*A47F 7/00* (2006.01)

(52) U.S. Cl.
CPC ..... *A47F 7/0071* (2013.01); *A47F 3/0478* (2013.01); *A47F 2003/046* (2013.01)

(56) References Cited

U.S. PATENT DOCUMENTS 4,651,536 A * 3/1987 Nax ..... A47F 3/0495 62/256
4,845,957 A 7/1989 Richardson
5,251,815 A 10/1993 Foye
5,390,206 A 2/1995 Rein et al.
5,658,607 A 8/1997 Herdeman
5,661,979 A 9/1997 Deboer
5,690,720 A 11/1997 Spero
5,872,721 A 2/1999 Huston et al.
6,471,136 B1 10/2002 Chatterjee et al.
7,114,650 B2 10/2006 Sherrod
7,118,608 B2 10/2006 Lovell
7,340,995 B2 3/2008 Chiang et al.
7,347,774 B2 * 3/2008 Aronstam ..... F24F 11/0001 454/258
7,367,198 B2 5/2008 Behr
8,632,737 B2 1/2014 Burg et al.
9,034,271 B2 5/2015 Shur et al.
9,195,804 B2 * 11/2015 Shoenfeld ..... G06F 19/3462
2006/0286918 A1 12/2006 Vargas
2008/0159910 A1 7/2008 Dick et al.
2010/0050665 A1 3/2010 Oswald et al.
2010/0058789 A1 3/2010 Barreto et al.
2011/0283633 A1 11/2011 Wallace
2012/0125018 A1 5/2012 Shaha et al.
2014/0263126 A1 9/2014 Lamontagne et al.
2015/0250331 A1 * 9/2015 Thorman ..... F25D 7/00 221/1
2015/0285541 A1 10/2015 Borchers et al.
2015/0355036 A1 12/2015 Giorgi et al.
2016/0058206 A1 * 3/2016 Schwalbach ..... A47F 3/001 361/752
2016/0113419 A1 * 4/2016 Wood ..... A47F 3/0447 108/50.18
2016/0182864 A1 6/2016 Izawa et al.
2018/0063900 A1 3/2018 Minvielle et al.
2018/0080703 A1 3/2018 Wilson

OTHER PUBLICATIONS

TROX Technik, "Airflow Control: Design Manual," TROX Technik, 2007, pp. 1-9.
International Search Report and Written Opinion for PCT Application No. PCT/US2018/15239, dated Apr. 3, 2018.
International Preliminary Report on Patentability in PCT/US2018/015239 dated Aug. 29, 2019; 7 pages.
Non-Final Office Action in U.S. Appl. No. 15/941,250 dated Dec. 2, 2019; 18 pages.

* cited by examiner

PANEL POWERED PRODUCE DISPLAY TABLE

RELATED APPLICATIONS

This application claims the benefit of U.S. Provisional Patent Application No. 62/458,817, filed Feb. 14, 2017 and entitled "Panel Powered Produce Display Table", and of U.S. Provisional Patent Application No. 62/458,822, Feb. 14, 2017 and entitled "Self-Powered Air Flow System for Retail Store Display," the contents of each of which are incorporated herein in their entirety.

TECHNICAL FIELD

The present inventive concepts relate generally to store produce displays, and more specifically, to powering and air conditioning perishable produce in a display apparatus.

BACKGROUND

Retail establishments face the ongoing challenge of storing and displaying fruits, vegetables, and/or other perishables and preserving their freshness as long as possible.

One approach is to provide a refrigerated environment where fresh cold air is pumped into the display. However, this requires an expensive infrastructure and limits mobility and flexibility of the display table

SUMMARY

In one aspect, provided is a display table or kiosk for store produce items, comprising: a base; a produce bed for holding retail produce items; an air flow system for providing air circulation and ventilation at the produce bed; and a self-contained power panel for powering the air flow system.

In another aspect, provided is a display table or kiosk for store produce items, comprising: a base; a bottom section for holding retail produce items; an air flow system for providing air circulation and ventilation for the produce items; and a solar panel for powering the air flow system.

In another aspect, provided is a display table or kiosk for store produce items, comprising: a base; a bottom section for holding retail produce items; an air flow system for providing air circulation and ventilation for the produce items; and a panel of incandescent-sensing devices for powering the air flow system.

In another aspect, provided is a display table for displaying perishable produce items, comprising: a base; a produce bed on which the perishable produce items are positioned; and an air flow system for providing air circulation and ventilation at the produce bed. The air flow system comprises a plurality of ducts under the produce bed; an air distribution box that evenly distributes the air through the ducts; and a plurality of fans that circulate the air from the ducts under the produce bed to a region above the produce bed. The display table further comprises a control device that controls a flow of the air via the fans to the produce bed according to a state of the perishable produce items on the produce bed; and a self-contained power panel that that generates power for the fans, the air distribution box, and the control device, wherein the power panel includes a cell power electrical system.

In another aspect, provided is a display table for displaying perishable produce items, comprising: a base; a produce bed on which the perishable produce items are positioned; and an air flow system for providing air circulation and ventilation at the produce bed, the air flow system comprising: a plurality of ducts under the produce bed; an air distribution unit that evenly distributes the air through the ducts; and a plurality of fans that circulate the air from the ducts under the produce bed to a region above the produce bed, the display table further comprising: a control device that controls a flow of the air via the fans to the produce bed according to a state of the perishable produce items on the produce bed; and a plurality of sensors at the produce bed that detect the state of the perishable produce items, wherein the control device adjusts the flow of the air in the produce bed in response to a signal received from the sensors regarding the detected state of the perishable produce items.

In another aspect, provided is a display table for displaying perishable produce items, comprising: a base; a produce bed on which the perishable produce items are positioned; and an air flow system for providing air circulation and ventilation at the produce bed, the air flow system comprising: a plurality of ducts under the produce bed; an air distribution unit that evenly distributes the air through the ducts; and a plurality of fans that circulate the air from the ducts under the produce bed to a region above the produce bed. The display table further comprising: a control device that controls a flow of the air via the fans to the produce bed according to a state of the perishable produce items on the produce bed; and a network interface for establish communications between the control device and a remote mobile electronic device, wherein the mobile electronic device is constructed and arranged to receive information regarding the state of the perishable produce items and to generate and output commands to the control device to control the flow of the air in the produce bed from the mobile electronic device.

BRIEF DESCRIPTION OF THE DRAWINGS

Advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION OF EMBODIMENTS

Figure 1:
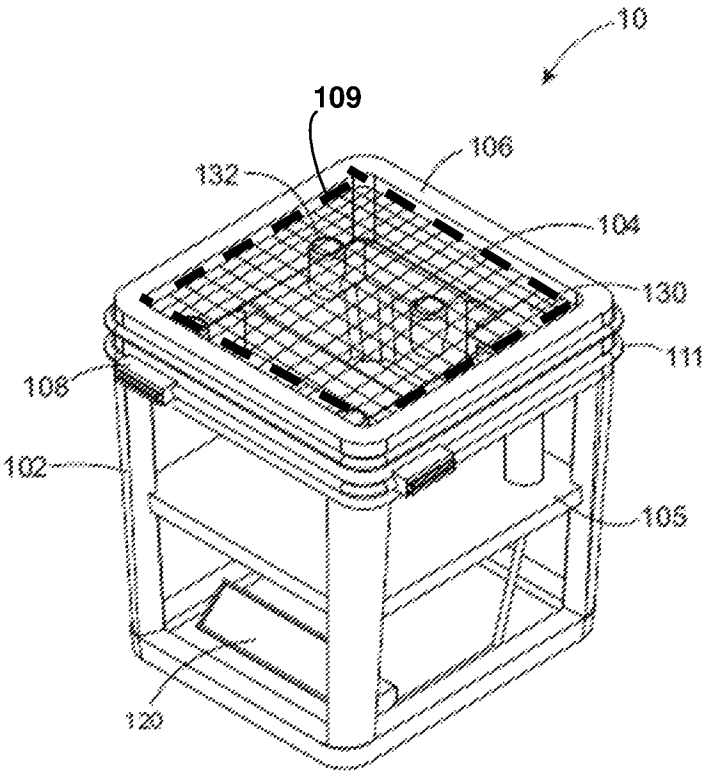
FIG. 1 is a perspective view of a produce display table, in accordance with some embodiments.

FIG. 1 is a perspective view of a produce display table 10, in accordance with some embodiments. The produce display table 10 is constructed and arranged to aid in the ripening of perishable store items, such as produce, and/or maintaining freshness of the produce. Related features may include providing ventilation for purging gases from the produce bed, preserving ripeness, freshness, or other desired benefits, and providing constant air circulation. In other embodiments, a storage apparatus different than a table may equally apply, such as a kiosk, counter, station, and so on.

In some embodiments, the display table 10 includes a base 102, a produce bed 104, a bottom section 105, an air flow system 130, and a self-contained power panel 120 for powering the air flow system 130 without the need for external outlet connections. In some embodiments, display table 10 may have a retractable wheel assembly (not shown). The display table 10 includes a compact design and configuration, which permits the presence of the bottom section 105, which may include shelves, additional bag holders, while also providing air circulation and/or ventilation by way of a self-contained power panel 120.

The base 102 and/or produce bed 104 can have a shape of a square, rectangular, oval, circle, polygon, trapezoid, or other shape, or a combination thereof. For example, the produce bed 104 and/or frame or border 106 about a perimeter of the produce bed 104, may have a rectangular shape with rounded corners. In some embodiments, the display table 10 has a unitary (not modular) construction. A cart bumping feature 111 may extend about some or all of an outer surface of the table border 106, for example, formed of foam, plastic, or the like for absorbing a force applied by a shopping cart or other object.

In some embodiments, the bottom section 105 can have one or more shelves, or slots, openings, or the like for storage. In some embodiments, the bottom section shelves 105 are positioned at a front, side, and/or back region of the display table 10. In other embodiments, the bottom section shelves 105 are positioned along a side of the display table 10. In other embodiments, for example, shown in FIG. 1, the shelves extend through a length of the base 102. The sides of the base 102 and/or bottom section 105 may be open, i.e., no structural walls, so that the air flow system 130 can receive sufficient ventilation for receiving and distributing a flow of air to the produce bed 104. The shelves in the bottom section 105 may similarly include vents, holes, or the like for receiving a flow of air. In some embodiments, the air flow system 130 may extend to the bottom section 105, for providing an air flow to items positioned at the bottom section 105.

The base 102 may include bag holders 108, for example, positioned at one or more corners of the display table 10 so that store customers can remove items from the display table 10 and place them in bags hanging from the holders 108. The bag holders 108 may be constructed and arranged as hooks, clamps, permanent or removable fixtures, or related support structures.

Figure 2:
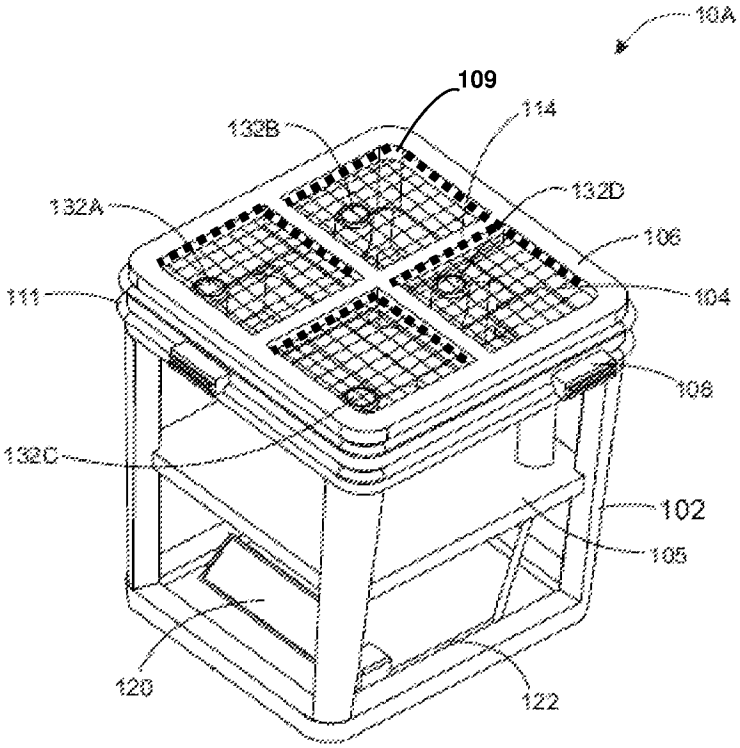
FIG. 2 is a perspective view of a produce display table, in accordance with other embodiments.

In some embodiments, as shown in FIG. 2, a display table 10A includes a produce bed 104 separated into multiple regions by one or more dividers 114. The display table 10A is similar to the display table 10 of FIG. 1 except for the presence of the dividers 114. Accordingly, references made to table 10 herein may equally apply to table 10A of FIG. 2. The border 106 about the perimeter of the produce bed 104 is constructed for containing items at the produce bed 104, and therefore preventing items from falling off the produce bed 104. The border 106 may be formed of a same or similar material as the base 102 or produce bed 104, such as metal and/or plastic. Alternatively, the border 106 can be formed of different materials, such as metal and/or plastic.

The produce bed 104 may be formed of a mesh, screen, or other porous configuration to provide sufficient ventilation and so that air may circulate from a region below the produce bed 104, for example, generated by the air flow system 130 below the table portion, to perishable items positioned on the produce bed 104. In some embodiments, the produce bed 104 may include a combination of solar panels or other radiation collecting elements, e.g., of photovoltaic cells of the power panel 120, and porous regions, for example, shown in FIG. 4.

Figure 5:
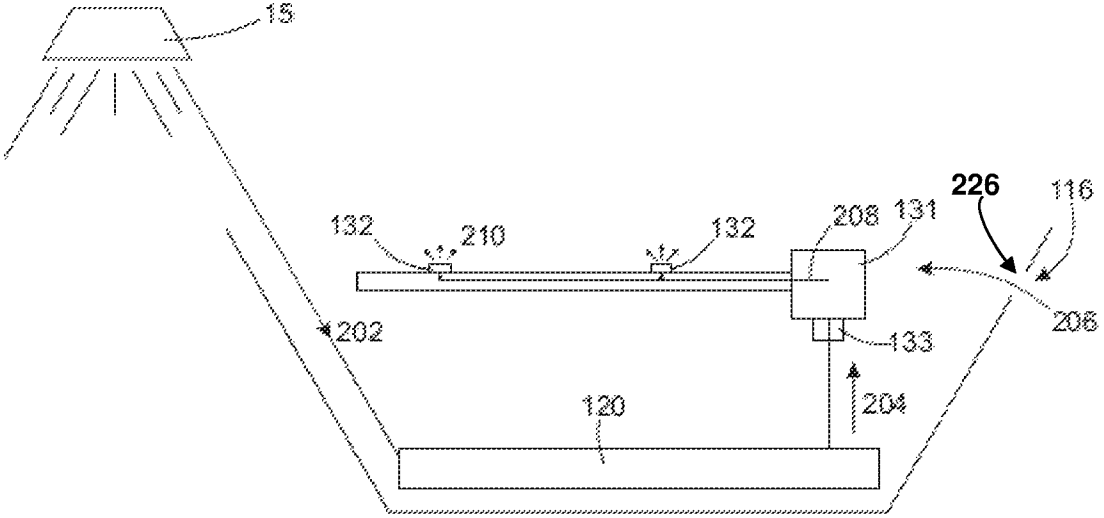
FIG. 5 is a schematic of a produce display table, including flow paths between elements of the produce display table, in accordance with other embodiments.

The air flow system 130 is constructed and arranged to for provide air circulation and ventilation for the produce items positioned on the produce bed 104 and/or bottom section 105, for example, shown in FIG. 5. In particular, the air flow system 130 circulates fresh air throughout the table display 10.

As described above, in some embodiments, the air flow system 130 is powered by the self-contained power panel 120. The air flow system 130 is constructed and arranged to for provide fresh air circulation and ventilation throughout the retail store display 10, which is received by the perishable items positioned at the retail store display 10. The self-powered air flow system 130 including the power panel 120 is preferably constructed for a compact configuration, for being positioned in the retail store display 10.

As shown, the air flow system 130 may include but is not limited to an air distribution unit 131, a plurality of fans 132 in communication with the air distribution unit 131 via a plurality of air ducts 137A-137N (generally, 137, where N is an integer greater than 1), or related pipes or air flow distribution elements, and a main electric fan with filter 133. In some embodiments, the air flow system 130 includes a single main fan 133 and six side fans 132, all powered by photovoltaic cells of the power panel 120 (described below). In some embodiments, the air flow system 130 includes four side fans 132 and two induction fans 220, some or all of which may be powered by photovoltaic cells of the power panel 120.

The fans 132, 133 are powered by a converter 135 that outputs AC or DC power via electrical wiring 134 of the like to the fans 132, 133. The fans 132, 133 are preferably low power fans. Here, each fan 132, 133 may require up to 5 volts and/or 2 amperes of electricity from the converter 135 and/or battery 142 (see FIG. 7) in communication with the power panel 120 and/or converter 135.

The side fans 132 are each constructed and arranged to output a source of air received via the ducts 137 from the air distribution unit 231. In some embodiments, the side fans 132 may be the same. In other embodiments, the side fans 132 may be different. For example, the side fans 132A-132D of FIG. 2 may have a different size or power requirement to circulate air in a different manner. The side fans 132 may be positioned under the bottom surface and/or extend from sidewalls of the display table 10 to direct air flow in a manner that minimizes any air flow escaping through the exposed top region of the display table 10.

The main fan 133, or intake fan, includes a filter for filtering air drawn in from the ambient environment. The air distribution unit 131 moves the air to the air ducts 137 for distribution to the side fans 132. The fans are arranged in the produce display table 10 that is exposed, i.e., not enclosed. Therefore, the arrangement of the fans are such that the air circulates in the produce bed regions with the sidewalls and bottom surface of the display table providing the boundaries for the air circulation, for example using dividers or the like. The direction of air flow may be parallel to the bottom surface to minimize any air flow escaping through the exposed top region of the display table.

The power panel 120 may include a plurality of photovoltaic cells, i.e., solar cells or the like for collecting and processing solar radiation, incandescent light, or other source of energy to convert it into electricity for powering the fans 132 of the air flow system 130. In some embodiments, the power panel 130 may include solar panels or the like that power a DC fan motor of the fans 132. The power panel 120 may include at least one battery 142 (see FIG. 7) for storing the collected and converted source of energy for subsequent output to the air flow system 130. In some embodiments, other electrical elements may receive the converted electricity from the power panel 120, for example, incandescent light bulbs.

In some embodiments, the produce display table 10 includes a plurality of meters and/or sensors 109 for detecting a state of produce items at the produce bed(s) 104 and/or the air flow output from the air flow system 130 to the produce bed(s) 104. Sensor examples may include but not limited to acoustic, vibration, chemical, moisture, humidity, position, angle, displacement, distance, speed, acceleration, optical, light, imaging, photon, pressure, force, weight, flow, haptic, density, thermal, heat, temperature, proximity, presence, or a combination thereof, and/or other sensor or meter types known to those of ordinary skill in the art. The sensors 109 may be located about a perimeter, or sidewalls, of the bed(s) 104 as shown, or located elsewhere on the display table 10. In some embodiments, the sensors 10 are powered by the power panel 120.

In some embodiments, the air flow system 130 is controlled by signals generated by the sensors 109. The signals may be analog or digital signals. For example, the produce bed 104 may include a bunch of bananas. A chemical detector of the sensors 109 may detect that that bananas are ripening at a rate that may shorten the shelf life of the bananas. A control device 228 (see FIG. 6) may be programmed to receive a signal from the chemical detector, and automatically control the air flow system 130 to increase or decrease an amount of air flow to the produce bed 104 in order to control how fast the bananas ripen.

In some embodiments, the control device 228 includes a network interface 229 for communicating with a mobile electronic device of a store associate or other user. For example, the user device, such as a smartphone, electronic notebook, laptop computer, and so on may have a Bluetooth™, WiFi, Ethernet, or other network connection that communicates with a comparable network interface 229 of the air flow system to exchange data related to the control of the produce display table 10 from the user device. For example, the user device may output a data command that instructs the air flow system 130 to change an amount of air flow, for example, bypassing an airflow sensor. In another example, the user device may receive sensor data regarding an undesirable deterioration of quality of a fruit or vegetable on the produce display table 10. This data may allow a store associate to proactively and remotely change the air flow, temperature, or other conditions of the produce display table 10.

Figure 4:
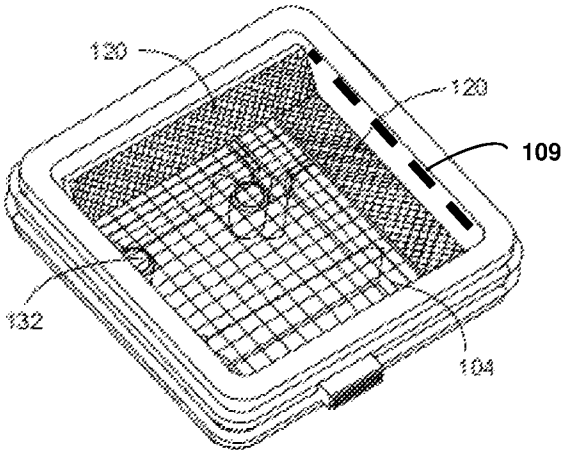
FIG. 4 is a close-up view of a region of a produce display table, in accordance with other embodiments.

In some embodiments, each divided region of the display table 10A shown in FIGS. 2 and 4 includes a dedicated fan 132. In some embodiments, the side fans 132 may be the same. In other embodiments, the side fans 132 may be different. For example, the side fans 132A-132D of FIG. 2 may have a different size or power requirement to circulate air in a different manner in each region of the produce bed 104. Similar to FIG. 1, the main fan 133, or intake fan, includes a filter for filtering air drawn in from the ambient environment at which the display table 10 is located, which is directed to the air distribution unit 131. In FIGS. 2 and 4, the air distribution unit 131 moves the air to the air ducts 137 for distribution to the various regions between the dividers 114 of the display table 10 via air ducts 137A-N to the side fans 132A-D.

As previously described, in some embodiments, the air flow system 130 is self-powered by the power panel 120. In some embodiments, the power panel 120 is positioned at the foot of the base 102, for example, as shown. However, the location of the power panel 120 is not limited to the base 102. For example, the power panel 120 may be positioned along the table border 102, the dividers 114, and/or the produce bed 104, and other region(s) of the produce display table 10 that can receive solar radiation, incandescent light, or other source of energy. For example, as shown in FIG. 4, some or all of the produce bed 104 may be configured to include solar panels or the like positioned along a top surface of the produce bed 104. In some embodiments, the produce bed 104 includes a material, or is coated with a material, that collects and converts a source or solar or incandescent energy into electricity.

The power panel 120 may include a plurality of photovoltaic cells, i.e., solar cells or the like for collecting and processing solar radiation, incandescent light, or other source of energy to convert it into electricity for powering the fans 132 of the air flow system 130. In some embodiments, the power panel 120 may include solar panels or the like that power a DC fan motor of the fans 132. The power panel 120 may include at least one battery 142 for storing the collected and converted source of energy for subsequent output to the air flow system 130. In some embodiments, other electrical elements may receive the converted electricity from the power panel 120, for example, light bulbs.

FIG. 5 is a schematic of a produce display table, including flow paths between elements of the produce display table, in accordance with other embodiments. Examples of a display table may include display table 10 of FIG. 1 or the display table 10A of FIG. 2, but not limited thereto. In embodiments herein when describing the display table 10 of FIG. 1, display table 10A of FIG. 2 may equally apply.

A light source 15 provides (202) a source of energy. A light source 15 may be the sun, ceiling lights, or other light source that permits sufficient power to be produced by the display table for powering (204) the fans 132, 133 of the air flow system 130. In producing power, the power panel 120 receives the source of energy, and the converter 135 converts the source of energy into AC or DC power for output to the fans 132, 133. The power panel 120 may include solar cells or other energy converting elements sufficient to power all of the fans 132, 133. The energy converting elements of the power panel 120 may be located at the produce bed 104, dividers 114, board 106, shelves 105, and/or other locations for receiving a source of radiation from the light source 15.

Flow path 206 illustrates a source of fresh air received at the display table 10 via vents 226 or the like, for example, a filtered region below the main fan 133. The source of fresh air may be vented by the side vents 226 and/or a filter of the main fan 133 to reduce or eliminate contamination. The main fan 133 directs the fresh air to the air distribution unit 131, which in turn distributes (208) the air to the side fans 132 for constant circulation (210) about the produce bed 104. In some embodiments, the fans 132 may also, or in addition, be positioned at the bottom section 105, for example, shelves where produce items may be positioned. The foregoing air flow paths may therefore equally apply to the bottom section 105.

Figure 6:
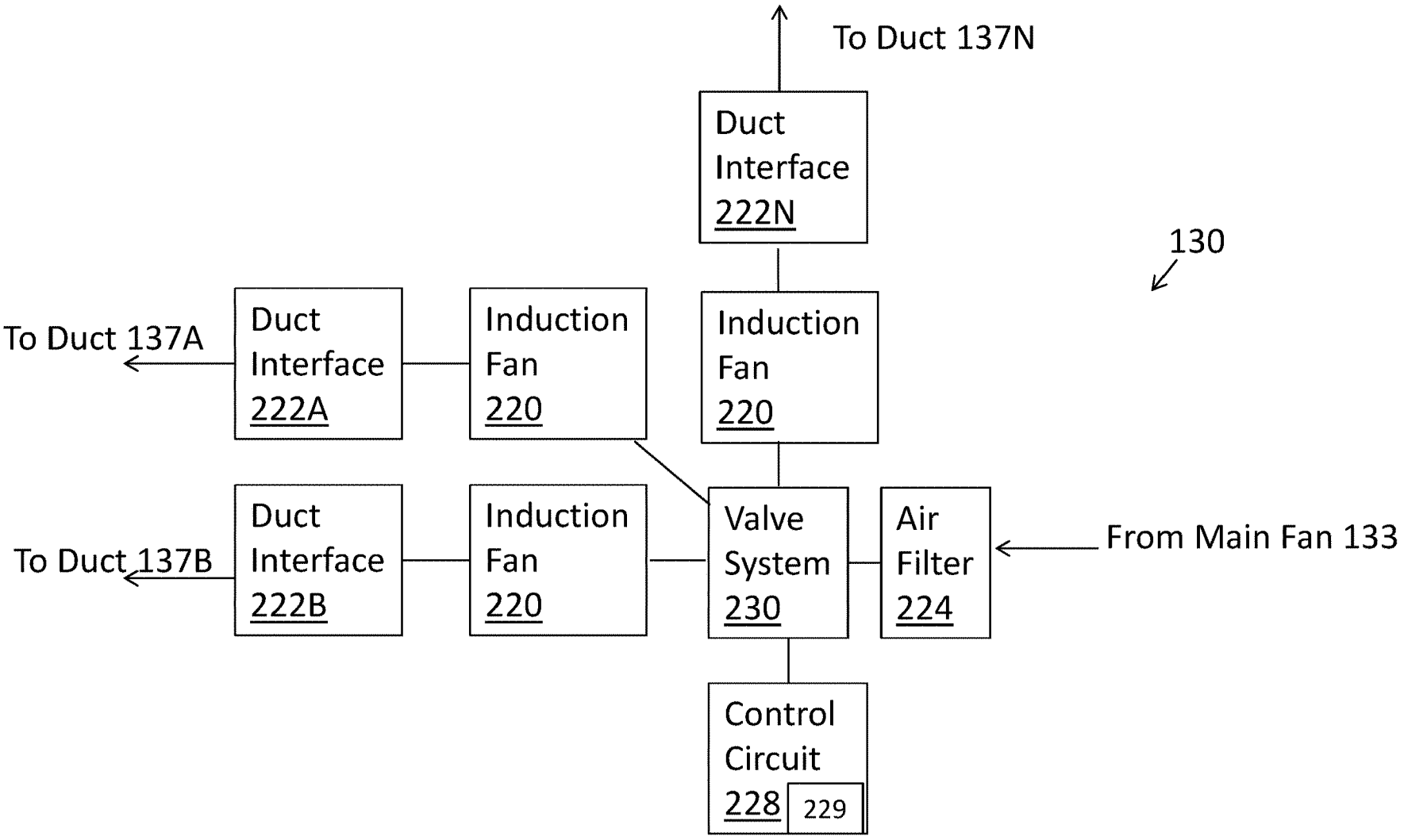
FIG. 6 is a block diagram of an air distribution unit of a self-powered air flow system, in accordance with other embodiments.

FIG. 6 is a block diagram of an air distribution unit 131 of a self-powered air flow system 130, in accordance with other embodiments.

The air distribution unit 131 may include but not be limited to an intake air filter 224, duct interfaces 222A-222N (generally, 222, where N is an integer greater than 1), a valve system 230, a controller, and an induction fan 220 for each duct interface 222.

During operation, the air distribution unit 131 receives external air, which is directed by the main fan 133 to the air filter 224. The air filter 224 prevents dust, debris, or other undesirable airborne particles from entering the air distribution unit 131. The valve system 230 distributes the air to the various duct interfaces 222 via induction fans 220, where the air exits the air distribution unit 131. The valve system 230 provides an air flow that is controlled, for example, mixed in a predetermined manner, by the control circuit 228. In some embodiments, control circuit 228 may receive control signals from an external device, for example, a remote computer that sends instructions on configuring or otherwise operating the valve system 230, and/or induction fans 220, for example, adjust the induction fans 220 to output filtered air at a flow rate specified by the received instructions. In some embodiments, the air distribution unit 131 does not include a control circuit 228 and instead includes a pre-configured set of ducts that distribute received air evenly to the duct interfaces 222. Here, the induction fans 220 can be preconfigured to output filtered air at a constant volume.

Figure 7:
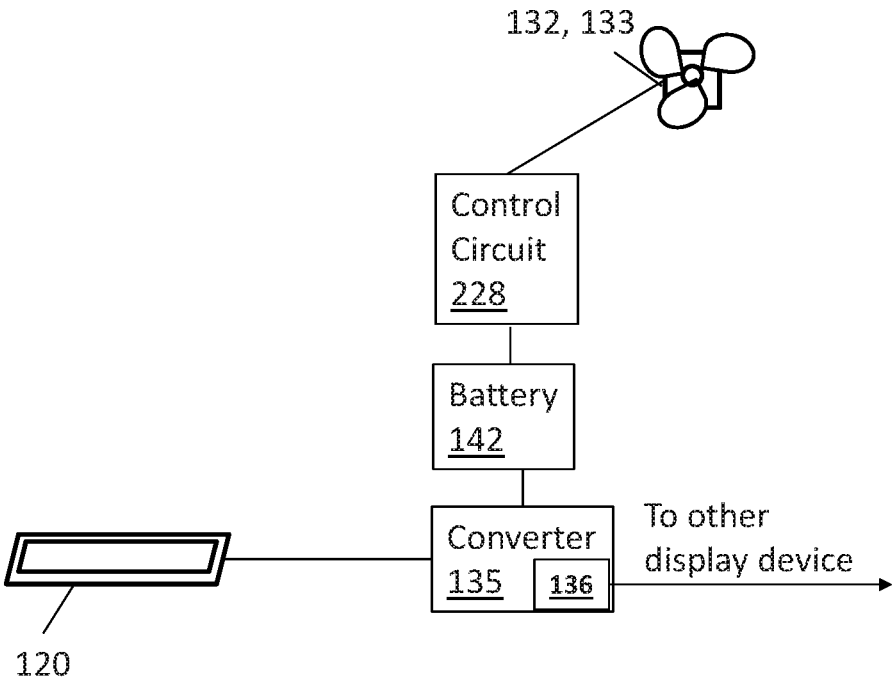
FIG. 7 is an electrical schematic for the self-powered air flow system of FIGS. 1-6.
Figure 8:
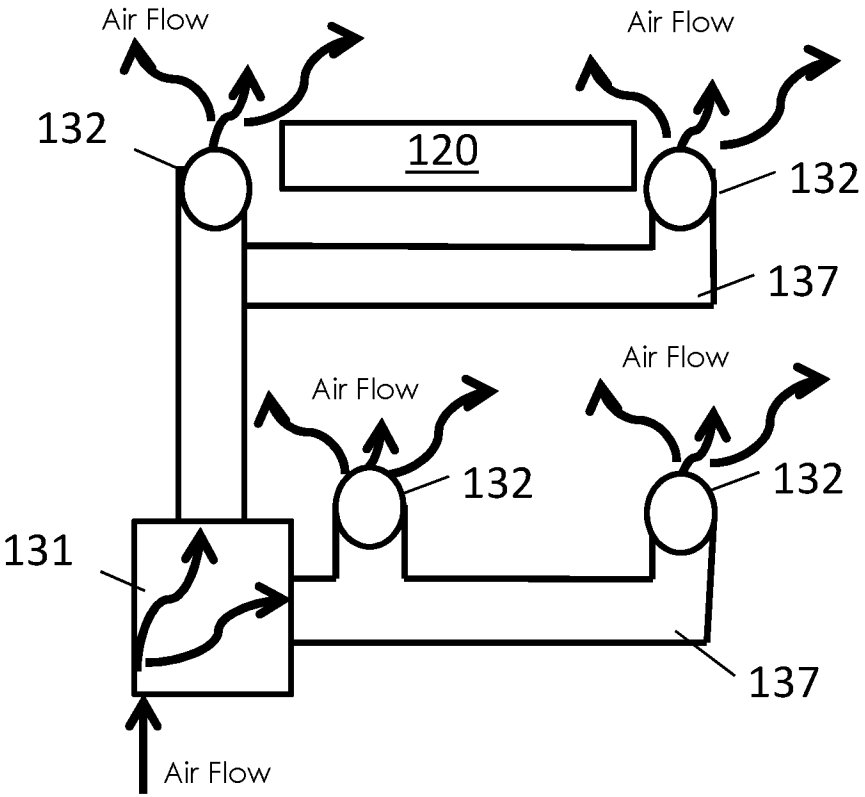
FIG. 8 is a schematic view of the self-powered air flow system of FIGS. 1-7 illustrating air flow paths between elements of the self-powered air flow system, in accordance with other embodiments.

FIG. 7 is an electrical schematic for the self-powered air flow system 130, in accordance with some embodiments. A light source such as the sun or incandescent light bulb provides a source of energy that provides sufficient power to the air flow system fans 132, 133, and/or other elements powered by electricity. In producing power, the power panel 120 receives the source of energy, e.g., rays from the sun, which is converted by the converter 135 into AC or DC power for output to the fans 132, 133, more specifically, fan motors, and/or other elements of the air distribution unit 131, for example, powering the control circuit 228. The converter 135 may provide DC power for charging or recharging an optional battery 142, which may provide backup power. Here, each fan 132, 133 may require up to 5 volts and/or 2 amperes of electricity from the converter 135 and/or battery in communication with the power panel 120 and/or converter 135. The power panel 120 may include solar cells or other energy converting elements sufficient to power all of the fans 132, 133. An optional switch (not shown) may be provided for connecting the solar power panel 120 when closed, and relying on battery power when open, for example.

In some embodiments, a plurality of display tables 10 may be connected to each other in a daisy-chain configuration, so that the batteries 142 on the attached carts can be charged by a display table 10, which receives power from a source of power, and it in turn powers the other display tables 10 in the chain forming a conductive path between the two or more display tables 10.

The converter 135 may include or otherwise be in electrical communication with a docking interface 136 that provides an upstream connection and/or downstream "daisy-chain" connection with a similar interface on a neighboring display table 10. A conductive cable or the like can be removably coupled or permanently attached to the docking interface 136 so that electricity produced at the battery 142, power panel 120, and/or AC power received from a connector plug from an electrical wall outlet can be output from the docking interface 136 through the conductive cable to a docking interface 136 or other coupling for charging the battery 142, capacitor, or other storage device on the neighboring display table 10. In some embodiments, the docking interface 136 may be used for powering a plurality of display tables 10 electrically connected together in a daisy-chain configuration. For example, two display tables 10 can each have a battery 142. Each battery 142 may have a positive connection point and a negative connection point. When the tables 10 are coupled together, for example, in a well-known electrical coupling arrangement, the positive and negative connections of the battery 142 of the first table form an electrical connection with the positive and negative connections of the battery 142 of the second table 10. In some embodiments, a smartphone or other electronic device coupled to a phone connector or USB port, or wirelessly connected is charged by the battery 142.

Figure 3:
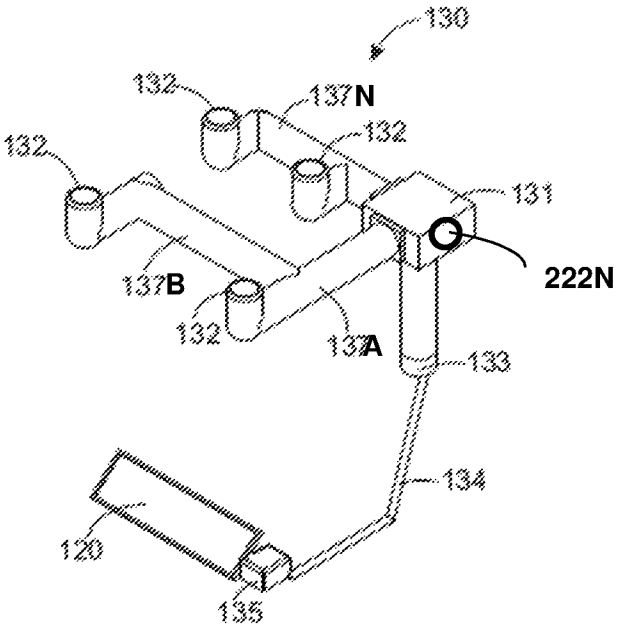
FIG. 3 is a perspective view of an air flow system for the produce display table of FIG. 1 or 2, in accordance with other embodiments.

In some embodiments, two or more display tables 10 may be connected in a daisy-chain configuration to exchange air flows. For example, one display table 10 may not have sufficient power to operate the fans of its air flow system 130. The control circuit 228 of a neighboring display table 10 may determine that it has sufficient power to output a source of generated air flow to the display table 10 having deficient power. For example, as shown in FIGS. 3 and 6, the air flow system 130 on one display table 10 may include an interface 222N for coupling to an air duct 137N of the neighboring display table 10. The control circuits 228 of the two display tables 10 may communicate with each other via a wireless communication, i.e., WiFi, Bluetooth, or the like, to control the flow of air via the duct interface 222N of one display table 10 to the duct 137N of the other display table 10.

The descriptions of the various embodiments of the present inventive concepts have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A display table for displaying perishable produce items, comprising:

a base;

a produce bed on which the perishable produce items are positioned having a top region exposed to an ambient environment; and an air flow system for providing air circulation and ventilation for purging gases from the produce bed, the air flow system comprising:

a plurality of ducts under the produce bed;

an air distribution unit that evenly distributes the air through the ducts; and a plurality of fans that circulate the air from the ducts under the produce bed to a region above the produce bed, wherein the fans are constructed and arranged to include a main fan that receives and output a source of air from the ambient environment to the ducts and at least one side fan that receives and directs the source of air from the ducts in a direction parallel to the produce bed to reduce an escape of circulated air from the top region exposed to the ambient environment, the display table further comprising:

a control device that controls a flow of the air via the fans to the produce bed according to a state of the perishable produce items on the produce bed; and a self-contained power panel that generates power for the fans, the air distribution unit, and the control device, wherein the power panel includes a cell power electrical system.

2. The display table of claim 1, further comprising a divider that forms sectional regions about the produce bed, wherein the control device controls the flow of the air in each sectional region independently according to a state of the perishable produce items in each sectional region.

3. The display table of claim 2, wherein the divider includes solar or incandescent-sensing devices of the self-contained power panel.

4. The display table of claim 1, wherein the power panel is a solar panel or incandescent power panel.

5. The display table of claim 1, further comprising a bottom section that holds a plurality of bags constructed and arranged for receiving the perishable produce items.

6. The display table of claim 1, wherein the air distribution unit includes at least one main fan for distributing the air evenly through the ducts, and wherein the at least one main fan and the plurality of fans are powered by the self-contained power panel.

7. The display table of claim 1, further comprising a filter for filtering the circulated air.

8. The display table of claim 1, wherein the air distribution unit includes an intake air filter, a plurality of duct interfaces, a valve system, a controller, and an induction fan for each duct interface.

9. The display table of claim 1, wherein the valve system distributes the filtered air evenly, and at a constant flow rate, through the ducts.

10. The display table of claim 1, further comprising a plurality of sensors at the produce bed that detect the state of the perishable produce items, wherein the control device adjusts the flow of the air in the produce bed in response to a signal received from the sensors regarding the detected state of the perishable produce items.

11. The display table of claim 1, wherein the control device includes a network interface for communicating with a remote mobile electronic device, wherein the mobile electronic device is constructed and arranged to receive information regarding the state of the perishable produce items and to generate and output commands to the control device to control the flow of the air in the produce bed from the mobile electronic device.

12. The display table of claim 1, further comprising a docking interface for providing at least one of power or air flow to another display table.

13. A display table for displaying perishable produce items, comprising:

a base;

a produce bed on which the perishable produce items are positioned; and an air flow system for providing air circulation and ventilation at the produce bed, the air flow system comprising:

a plurality of ducts under the produce bed;

an air distribution unit that evenly distributes the air through the ducts, wherein the air distribution unit includes an intake air filter, a plurality of duct interfaces, a valve system, a controller, and an induction fan for each duct interface; and a plurality of fans that circulate the air from the ducts under the produce bed to a region above the produce bed, the display table further comprising:

a control device that controls a flow of the air via the fans to the produce bed according to a state of the perishable produce items on the produce bed; and a plurality of sensors at the produce bed that detect the state of the perishable produce items, wherein the control device adjusts the flow of the air in the produce bed in response to a signal received from the sensors regarding the detected state of the perishable produce items.

14. The display table of claim 13, further comprising a bottom section that holds a plurality of bags constructed and arranged for receiving the perishable produce items.

15. The display table of claim 13, further comprising a divider that forms sectional regions about the produce bed, wherein the control device controls the flow of the air in each sectional region independently according to a state of the perishable produce items in each sectional region.

16. The display table of claim 13, further comprising a plurality of solar or incandescent-sensing devices for self-powering electrical components of the display table, the electrical components including the air distribution unit, the fans, the control device, and the sensors.

17. A display table for displaying perishable produce items, comprising:

a base;

a produce bed on which the perishable produce items are positioned; and an air flow system for providing air circulation and ventilation at the produce bed, the air flow system comprising:

a plurality of ducts under the produce bed;

an air distribution unit that evenly distributes the air through the ducts; and a plurality of fans that circulate the air from the ducts under the produce bed to a region above the produce bed, the display table further comprising:

a control device that controls a flow of the air via the fans to the produce bed according to a state of the perishable produce items on the produce bed; and a network interface for establish communications between the control device and a remote mobile electronic device, wherein the mobile electronic device is constructed and arranged to receive information regarding the state of the perishable produce items and to generate and output commands to the control device to control the flow of the air in the produce bed from the mobile electronic device, the display table further comprising:

a plurality of sensors at the produce bed that detect the state of the perishable produce items, wherein the control device adjusts the flow of the air in the produce bed in response to a signal received from the sensors regarding the detected state of the perishable produce items, wherein the network interface is configured to receive a data command from the mobile electronic device for the control device to instruct the air flow system to bypass the sensors and to change the flow of the air independently of the sensors.

* * * * *